US009200408B2

(12) United States Patent
Granger et al.

(10) Patent No.: US 9,200,408 B2
(45) Date of Patent: Dec. 1, 2015

(54) METHOD OF DELIVERING A PIGMENT DISPERSION AND RETENTION AID TO A PAPERMAKING PROCESS

(71) Applicant: Ecolab USA Inc., Naperville, IL (US)

(72) Inventors: William A Granger, Fort Gratiot, MI (US); George L Dennis, Wilmington, DE (US); Tommy Jacobson, Helsinki (FI)

(73) Assignee: ECOLAB USA INC., St. Paul, MN (US)

( * ) Notice: Subject to any disclaimer, the term of this patent is extended or adjusted under 35 U.S.C. 154(b) by 4 days.

(21) Appl. No.: 14/069,488

(22) Filed: Nov. 1, 2013

(65) Prior Publication Data

US 2014/0124153 A1 May 8, 2014

Related U.S. Application Data

(60) Provisional application No. 61/721,537, filed on Nov. 2, 2012.

(51) Int. Cl.

| | |
|---|---|
| ***D21H 17/67*** | (2006.01) |
| ***D21H 21/10*** | (2006.01) |
| ***D21H 21/28*** | (2006.01) |
| ***D21H 27/00*** | (2006.01) |
| ***D21H 17/37*** | (2006.01) |
| ***D21H 17/52*** | (2006.01) |
| ***D21H 21/20*** | (2006.01) |

(52) U.S. Cl.

CPC ..... *D21H 17/675* (2013.01); *D21H 17/375* (2013.01); *D21H 17/52* (2013.01); *D21H 21/20* (2013.01); *D21H 27/005* (2013.01)

(58) Field of Classification Search

USPC ..... 162/164.6, 168.1–168.3, 181.1, 162/181.4–181.5, 158, 185, 380; 137/597, 137/896; 222/129, 145.1, 145.5, 566

See application file for complete search history.

(56) References Cited

U.S. PATENT DOCUMENTS

| | | | | |
|---|---|---|---|---|
| 6,103,065 | A * | 8/2000 | Humphreys et al. | 162/181.8 |
| 6,579,410 | B1 * | 6/2003 | Bleakley et al. | 162/9 |
| 7,550,060 | B2 * | 6/2009 | Jacobson et al. | 162/158 |
| 7,758,725 | B2 | 7/2010 | Matula | |
| 7,938,934 | B2 * | 5/2011 | Todorovic et al. | 162/164.6 |
| 2004/0221977 | A1 | 11/2004 | Vergara Lopez | |
| 2005/0161183 | A1 | 7/2005 | Covarrubias | |
| 2006/0137843 | A1 * | 6/2006 | Sutman et al. | 162/158 |
| 2008/0011788 | A1 | 1/2008 | Jacobson et al. | |
| 2012/0103549 | A1 | 5/2012 | Ban | |

OTHER PUBLICATIONS

International Search Report for PCT/US2013/068164, World Intellectual Property Organization (WIPO), 2014, [online], Retrieved from the Internet, [retrieved Dec. 27, 2014, <URL: http://patentscope.wipo.int/search/docservicepdf_pct/id00000024897897.pdf>.*

Smook, Gary A., Handbook for Pulp and Paper Technologists, 2nd ed, Angus Wilde Publications, 1992, p. 220.*

* cited by examiner

*Primary Examiner* — Dennis Cordray

(74) *Attorney, Agent, or Firm* — Benjamin Carlsen

(57) ABSTRACT

The disclosure is directed toward methods for delivering a pigment dispersion and an inverted retention aid emulsion to a papermaking process. The method comprises injecting the pigment dispersion and the inverted retention aid emulsion into a process line of the papermaking process. The pigment dispersion comprises titanium dioxide, and the retention aid may comprise an anionic flocculant. The process line is located downstream from a screen and upstream from a headbox. The methods may incorporate the use of one or several nozzle devices.

20 Claims, 6 Drawing Sheets

METHOD OF DELIVERING A PIGMENT DISPERSION AND RETENTION AID TO A PAPERMAKING PROCESS

FIELD OF THE INVENTION

The present application relates to improvements in the papermaking process. More particularly, the present application relates to improvements in the delivery of a pigment to the papermaking process. In certain embodiments, the pigment is injected into the papermaking process as a dispersion relatively near the point of injection of a retention aid, subsequent a screen and prior to a headbox. In certain embodiments, the pigment comprises titanium dioxide.

BACKGROUND

Various types and amounts of chemical species are added to a papermaking process. In particular, chemicals are added into a process line of the papermaking process. The optimal location of injection of these chemical species is both a quality and a cost issue in that the optimal injection of the chemical species into a process line results in the following: a) better runnability of the paper machine; b) the quantity of the end product is more predictable and uniform; c) less web breaks and down-time of the paper machine; d) a reduction in the quantity of the chemical that needs to feed into a papermaking machine; e) smaller consumption of fresh water; and f less energy is needed to heat fresh water.

Titanium dioxide is a pigment used in the papermaking process to improve opacity of the sheet. Titanium dioxide helps make the sheet whiter while making the sheet less light-penetrable. In a typical papermaking process, titanium dioxide is added to a furnish as a dispersion in an aqueous liquid to the wet end of the papermaking process prior to the fan pump. Such addition typically results in uneven distribution of titanium dioxide across the sheet. The typical papermaking process adds excess titanium dioxide to the furnish in order to meet quality standards related to opacity, thereby increasing the cost of production.

SUMMARY OF THE INVENTION

The disclosure is directed toward a method for delivering a pigment dispersion and an inverted retention aid emulsion to a papermaking process. The method comprises injecting the pigment dispersion and the inverted retention aid emulsion into a process line of the papermaking process. The pigment dispersion comprises titanium dioxide. The process line is located downstream from a screen and upstream from a headbox.

The disclosure is also directed toward a method for delivering a pigment dispersion and an inverted retention aid emulsion to a papermaking process. The method comprises injecting the pigment dispersion into a process line of the papermaking process via a first nozzle device, wherein the pigment dispersion comprises titanium dioxide and water; injecting the inverted retention aid emulsion into the process line of the papermaking process via a second nozzle device, wherein the inverted retention aid emulsion comprises a flocculant and water. The process line is located downstream from a screen and upstream from a headbox.

The disclosure is further directed toward a method of optimizing pigment use in a papermaking process. The method comprises injecting a pigment dispersion and an inverted retention aid emulsion to a process line of the papermaking process. The process line operably connects a screen and a headbox. The pigment dispersion comprises titanium dioxide. The inverted retention aid emulsion comprises an anionic flocculant.

BRIEF DESCRIPTION OF THE SEVERAL VIEWS OF THE DRAWINGS

The benefits and advantages of the present disclosure will become more readily apparent to those of ordinary skill in the relevant art after reviewing the following detailed description and accompanying drawings, wherein.

DETAILED DESCRIPTION OF THE INVENTION

Figure 1:
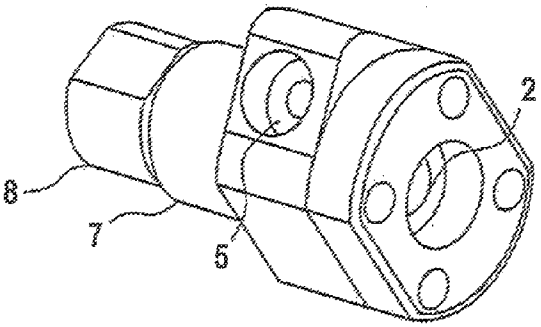
FIG. 1 is a side elevation view of an embodiment of a nozzle device.
Figure 2:
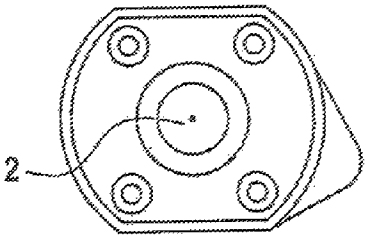
FIG. 2 is a cross-sectional view of the embodiment of the nozzle device of FIG. 1.
Figure 3:
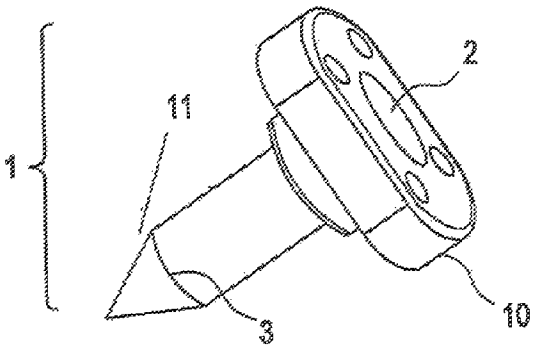
FIG. 3 is a side elevation view of a first conduit of the embodiment of the nozzle device of FIG. 1.
Figure 4:
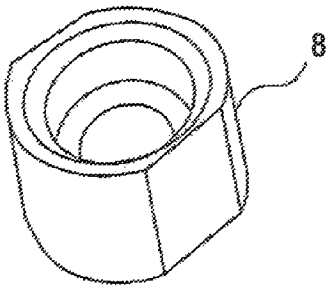
FIG. 4 is a side elevation view of an adaptor of an embodiment of the nozzle device of FIG. 1.
Figure 5:
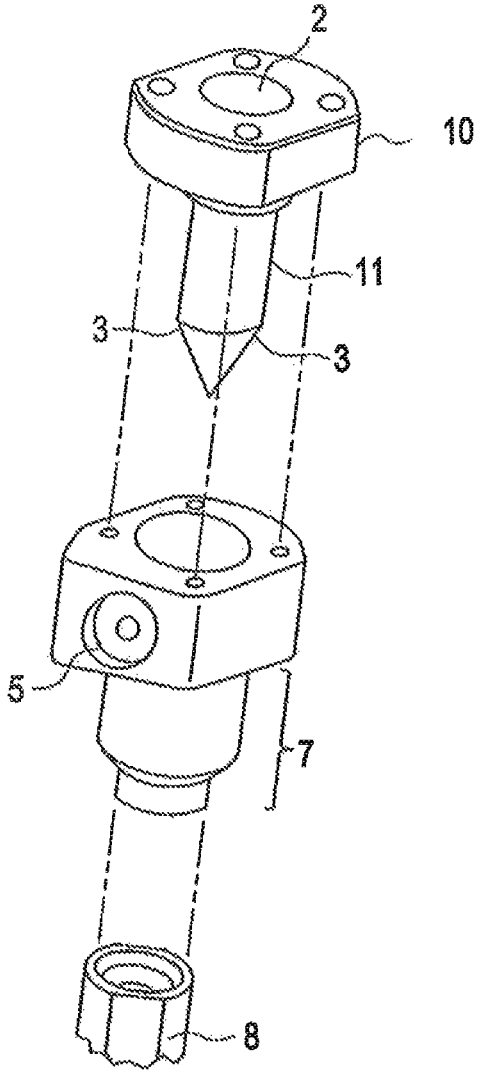
FIG. 5 is an exploded side elevation view of a first conduit, second conduit, mixing chamber and adaptor of an embodiment of a nozzle device.

While the embodiments described herein may take various forms, there is shown in the drawings and will hereinafter be described presently preferred embodiments with the understanding that the present disclosure is to be considered merely an exemplification and is not intended to limit the disclosure to the specific embodiments illustrated.

It should be further understood that the title of this section of this specification, namely, "Detailed Description of the Invention," relates to a requirement of the United States Patent Office, and does not imply, nor should be inferred to limit the subject matter disclosed herein.

The disclosure is directed toward a method for delivering a pigment dispersion and an inverted retention aid emulsion to a papermaking process. The method comprises injecting the pigment dispersion and the inverted retention aid emulsion into a process line of the papermaking process. The pigment dispersion comprises titanium dioxide. The process line is located downstream from a screen and upstream from a headbox.

The disclosure is also directed toward a method for delivering a pigment dispersion and an inverted retention aid emulsion to a papermaking process. The method comprises injecting the pigment dispersion into a process line of the papermaking process via a first nozzle device, wherein the pigment dispersion comprises titanium dioxide and water; injecting the inverted retention aid emulsion into the process line of the papermaking process via a second nozzle device, wherein the inverted retention aid emulsion comprises a flocculant and water. The process line is located downstream from a screen and upstream from a headbox.

The disclosure is further directed toward a method of optimizing pigment use in a papermaking process. The method comprises injecting a pigment dispersion and an inverted retention aid emulsion to a process line of the papermaking process. The process line operably connects a screen and a headbox. The pigment dispersion comprises titanium dioxide. The inverted retention aid emulsion comprises an anionic flocculant.

The following definitions are employed for this disclosure:

The term "chemical species" is used to refer to any one or more of the following: a pigment dispersion, a retention aid, and/or a retention aid emulsion (either inverted or uninverted), or any one or more of the active ingredients of any of the pigment dispersion and/or the retention aid emulsion.

"Papermaking process" means a method of making paper products from pulp generally comprising forming an aqueous cellulosic papermaking furnish, draining the furnish to form a sheet and drying, the sheet. The steps of forming the papermaking furnish, draining, and drying may be carried out in any conventional manner generally known to those skilled in the art. The pulp may be any either or both of the following: virgin pulp and recycled pulp.

"Thin stock line" means a pipeline between a machine chest and headbox of a paper machine.

In certain embodiments, the retention aid is injected to the papermaking process as an inverted retention aid emulsion. A retention aid is known in the papermaking industry as the operable chemical ingredient that helps the sheet retain additives and/or fillers that are added to the pulp, furnish, or sheet thereby enhancing the performance of the sheet, or decreasing the cost of making the sheet. In a retention aid emulsion, which is typically inverted prior to being injected into the papermaking process, the retention aid is the operable chemical ingredient (e.g., an anionic flocculant). For purposes of this disclosure, the term "retention aid" is meant to include any composition comprising an operable chemical ingredient that helps the sheet retain chemicals and/or fillers that are added to the pulp, furnish, or sheet that enhance the performance or decrease the cost of the sheet. As used herein, the term "retention aid" should be construed to encompass the terms "retention aid emulsion," "uninverted retention aid emulsion," "inverted retention aid emulsion," and "retention aid solution" unless it is otherwise clear from the context that another non-interchangeable meaning is intended. Furthermore, the term "inverted retention aid emulsion" is meant to encompass both an uninverted retention aid emulsion that has been inverted as well as a retention aid solution.

In certain embodiments, the retention aid is injected as an inverted retention aid emulsion. In certain embodiments, the inverted retention aid emulsion is delivered to the nozzle device and then injected into the process line. In certain embodiments, the retention aid is delivered to the nozzle device as an uninverted retention aid emulsion and then mixed with an aqueous liquid thereby inverting the retention aid emulsion. In such embodiments, the inverted retention aid emulsion is then injected into the process line of the papermaking process. Inverting an emulsion is also known as "making down."

In certain embodiments, the pigment dispersion is titanium dioxide dispersed in an aqueous liquid, which is delivered to the nozzle device and then injected into the process line. In certain embodiments, titanium dioxide is delivered to the nozzle device as a concentrated pigment dispersion and then mixed with additional aqueous liquid thereby diluting to form the pigment dispersion. In such embodiments, the pigment dispersion is injected the process line of the papermaking process. In certain embodiments, the concentrated pigment dispersion comprises 60-80% by weight titanium dioxide, and the concentrated pigment dispersion is diluted to 25-35% by weight titanium dioxide thereby forming the pigment dispersion.

In certain embodiments, the chemical species are injected into the process line at a rate of 10-30 gallons per minute per nozzle device. In certain embodiments, the chemical species are injected into the process line at pressures ranging from 80 to 160 psig.

In certain embodiments, the process line is a thin stock line.

In certain embodiments, the retention aid emulsion prior to inversion ("uninverted") is an oil-in-water emulsion. In certain embodiments, the retention aid emulsion (uninverted and inverted) comprises an anionic flocculant. The anionic flocculant may comprise an anionic polyacrylamide. In certain embodiments, the inverted retention aid emulsion is injected into the process line at a rate ranging from 0.1 lb anionic flocculant per ton dry sheet to 5 lb anionic flocculant per ton dry sheet. In certain embodiments, the inverted retention aid emulsion is injected into the process line such that the anionic flocculant is present in the product sheet at a concentration ranging from 0.1 lb/ton to 5 lb/ton. In certain embodiments, the anionic flocculant has a molecular weight ranging from one thousand Daltons to twenty million Daltons.

In certain embodiments, the anionic flocculant is selected from the group consisting of homopolymers, copolymers, terpolymers of acrylamide, acrylic acid, partially hydrolyzed acrylic acid, partially hydrolyzed acrylamide, 2-acrylamido-2-methylpropanesulfonate, 2-acrylamidoethanesulfonate, styrenesulfonate, ethylene oxide, vinyl alcohol, alkyl hydroxamate, methacrylate, itaconic acid, fumaric acid, crotonic acid, maleic acid, itaconic acid esters, fumaric acid esters, maleic acid esters, alpha-haloacrylic acid, vinylacetic acid, allylacetic acid, beta-carboxyethylacrylate, sulfoalkyl acrylate, sulfoalkyl methacrylate, allylsulfonic acid, methallylsulfonic acid, N-sulfohydrocarbon-substituted acrylamide (e.g., sulfomethylated acrylamide), and combinations thereof. The flocculant may take the form of one or more anionic polymers and/or as salt of one or more anionic polymers.

In certain embodiments, the pigment dispersion and the inverted retention aid emulsion are injected no more than twelve inches (30 cm) upstream or downstream from one another. In certain embodiments, the pigment dispersion and the inverted retention aid are injected no more than six inches (15 cm) upstream or downstream from one another. In certain embodiments, the pigment dispersion and the inverted retention aid emulsion are injected in the same cross-section of the process line. In certain embodiments, the pigment dispersion and the inverted retention aid emulsion are injected equidistant from a headbox. In certain embodiments, the pigment dispersion and the inverted retention aid emulsion are injected via the same nozzle device.

In certain embodiments, the pigment dispersion and the inverted retention aid emulsion are injected simultaneously in time.

In certain embodiments, the pigment dispersion and/or the inverted retention aid emulsion are injected via at least one nozzle device. In certain embodiments, the pigment dispersion and the inverted retention aid emulsion are injected via separate nozzle devices. Any number of nozzle devices may be used, and the employment of an equal number of nozzle devices for each is not necessary. For example, the pigment dispersion may be injected into the process line via one nozzle device, but the inverted retention aid emulsion may be injected into the process line via two nozzle devices.

While various nozzle devices are envisioned to be able to carry out the disclosed methods, examples of particularly suited nozzle devices are disclosed in U.S. Pat. Nos. 7,550,060; 7,785,442; 7,938,934; and 7,981,251, the disclosures of each of which are herein incorporated by reference (e.g., Nalco Pareto Technology, available from Nalco Company, 1601 West Diehl Road, Naperville, Ill. 60563), and the Ultra Turax, model no. UTI-25 (available from IKA® Works, Inc., Wilmington, N.C.).

The number identifiers referenced throughout the Detailed Description of the invention are noted on at least one of FIGS. 1-9; the number identifiers are consistent throughout all FIGs. and, therefore when reading the Detailed Description of the invention, please reference any of the nine FIGs. as may be necessary.

As illustrated in the FIGs., in certain embodiments, the nozzle device includes four primary components: a first conduit (1); a second conduit (4); a mixing chamber (7); and optionally an adaptor (8). The dimensions and geometries of each element of the nozzle device depends upon how much of a chemical species needs to be added to the papermaking process, as well other factors, such as the construction of the process line (9). The nozzle device may be made of any suitable material for handling various types of papermaking chemicals, for example, stainless steel.

In certain embodiments of the nozzle device, the first conduit (1) has at least one inlet (2) and at least one outlet (3). In certain embodiments of the nozzle device, the conduit has both a head portion (10) and a portion (11) that is conical in shape.

In certain embodiments of the nozzle device, the second conduit (4) has at least one inlet (5) and at least one outlet (6). The second conduit (4) may be securely fastened to the first conduit's head portion (10). For example, the head portion (10) of the first conduit and the second conduit (4) may have at least one opening so that a screw can secure one conduit to another.

In certain embodiments of the nozzle device, the mixing chamber (7) has at least one inlet (17) and at least one outlet (18) that are in communication with the at least one outlet of both the first conduit (1) and the second conduit (4). The mixing chamber (7) secures to the second conduit (4). The mixing chamber (7) is operably attached to the second conduit (4). For example, both the second conduit (4) and the mixing chamber (7) may be a single manufactured structure.

In certain embodiments, the optional adaptor (8) secures to the mixing chamber (7) and is communication with the at least one outlet (18) of the mixing chamber (7). The adaptor (8) may securely fasten to the mixing chamber (7). For example, a portion of the mixing chamber (7) may insert into the adaptor (8). It is important to note that the adaptor (8) is an optional feature of certain embodiments of the nozzle device, which itself may take various forms. However, the nozzle device should be operably attached to the process line (9) such that the chemical species are delivered to the furnish (13).

In certain embodiments of the nozzle device, the at least one inlet (5) of said second conduit (4) is perpendicular to said at least one outlet (6) of said second conduit (4).

In certain embodiments of the nozzle device, the first conduit (1) traverses said second conduit (4) perpendicular to the flow of aqueous fluid (15) into the at least one inlet (5) of said second conduit (4).

As stated above, the present disclosure provides for a method of delivering a pigment dispersion and a retention aid/inverted retention aid emulsion to a papermaking process. In certain embodiments of the nozzle device (12), an optional adaptor (8), alone or as part of the nozzle device (12), is mounted at an opening (16) in the process line (9). The optional adaptor (8) is secured to the process line (9) such that the at least one outlet (18) of the nozzle device (12), once attached, is in fluid communication with the furnish (13) that is flowing through the process line (9). After this setup is established, the pigment dispersion and/or the retention aid/inverted retention aid emulsion are introduced into the nozzle device (12), mixed in the mixing chamber (7), and injected into the process line (9).

In certain embodiments, the co-feeding of different chemical species into a furnish (13) can be achieved by the following steps: introducing each of the chemical species into at least one nozzle device, allowing a mixture of the chemical species to form, and injecting the mixture into the furnish. In certain embodiments, the chemical species may be injected via a plurality of nozzle devices. The chemical species may be injected individually or as a mixture. In certain embodiments, the pigment dispersion and the retention aid/inverted retention aid emulsion are injected into the process line via separate nozzle devices. In certain embodiments, at least two of the nozzle devices are mounted in the same cross-section of the process line so as to inject each of the pigment dispersion and the retention aid/inverted retention aid emulsion into the process line at essentially the same point in the furnish flow. In certain embodiments, the pigment dispersion and the retention aid/inverted retention aid emulsion are added simultaneously in time.

Figure 8:
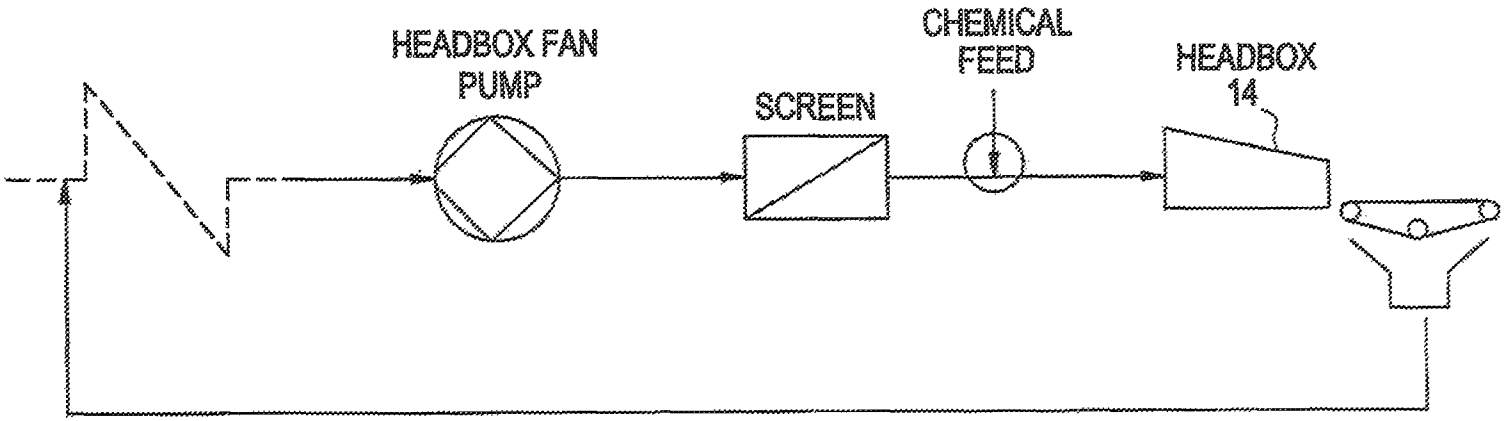
FIG. 8 illustrates a schematic drawing of an embodiment of a papermaking process as it pertains to a headbox approach system/thin stock line.

In certain embodiments, as illustrated in FIG. 8, at least one nozzle device that injects a chemical species is positioned proximate to a headbox (14) of said papermaking process. This orientation reduces the possibility of deactivation of the chemical species added to the process line and unnecessary time delays, which reduces the amount of chemical species needed, and provides better control of both the retention aid and the pigment dispersion, which in turn provides better opacity control of the product sheet. In certain embodiments, at least two nozzle devices are positioned equidistant from the headbox, thereby allowing for the pigment dispersion and the retention aid/inverted retention aid emulsion to be injected equidistant from the headbox.

In certain embodiments, the mixing is a staged mixing, i.e., mixing of the pigment dispersion and/or mixing of the inverted retention aid emulsion occur prior to their injection into the process line. Staged mixing lasts for a time period that comports with the desired reaction rate of the pigment dispersion and/or inverted retention aid emulsion in the nozzle device. In certain embodiments, the staged mixing lasts from about 5 microseconds to about 500 milliseconds.

In certain embodiments, the activity of the chemical species is controlled by adjusting the flow rate of the chemical species and an aqueous liquid, which, in certain embodiments, are introduced into the at least one nozzle device. At least one pump in communication with the at least one nozzle device may adjust the flow rate of the chemical species and the aqueous liquid that are being introduced into the at least one nozzle device. Staged mixing can be achieved in the nozzle device by controlling flow rates of the chemical species and the aqueous liquid into the nozzle device.

In certain embodiments, a concentrated pigment dispersion and/or an uninverted retention aid emulsion are diluted with an aqueous liquid prior to their introduction in the nozzle device thereby creating the pigment dispersion and/or the inverted retention aid emulsion.

In certain embodiments, the process line contains a furnish of a papermaking process. In further embodiments, the process line is a thin stock line.

Figure 6:
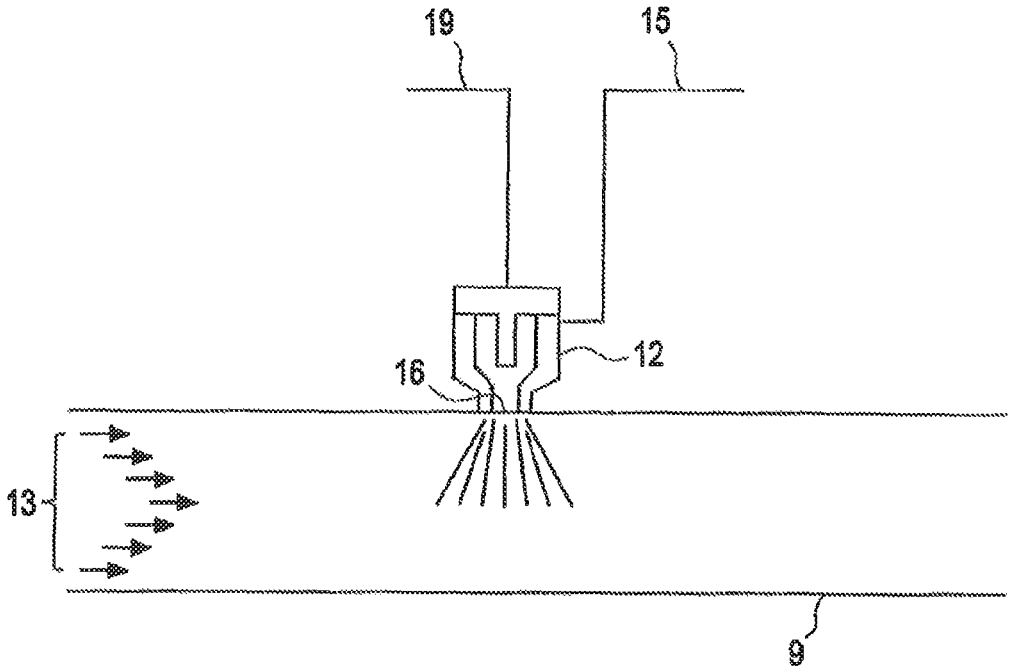
FIG. 6 represents a schematic illustration of a method of injecting a chemical into a process line via a nozzle device.
Figure 7:
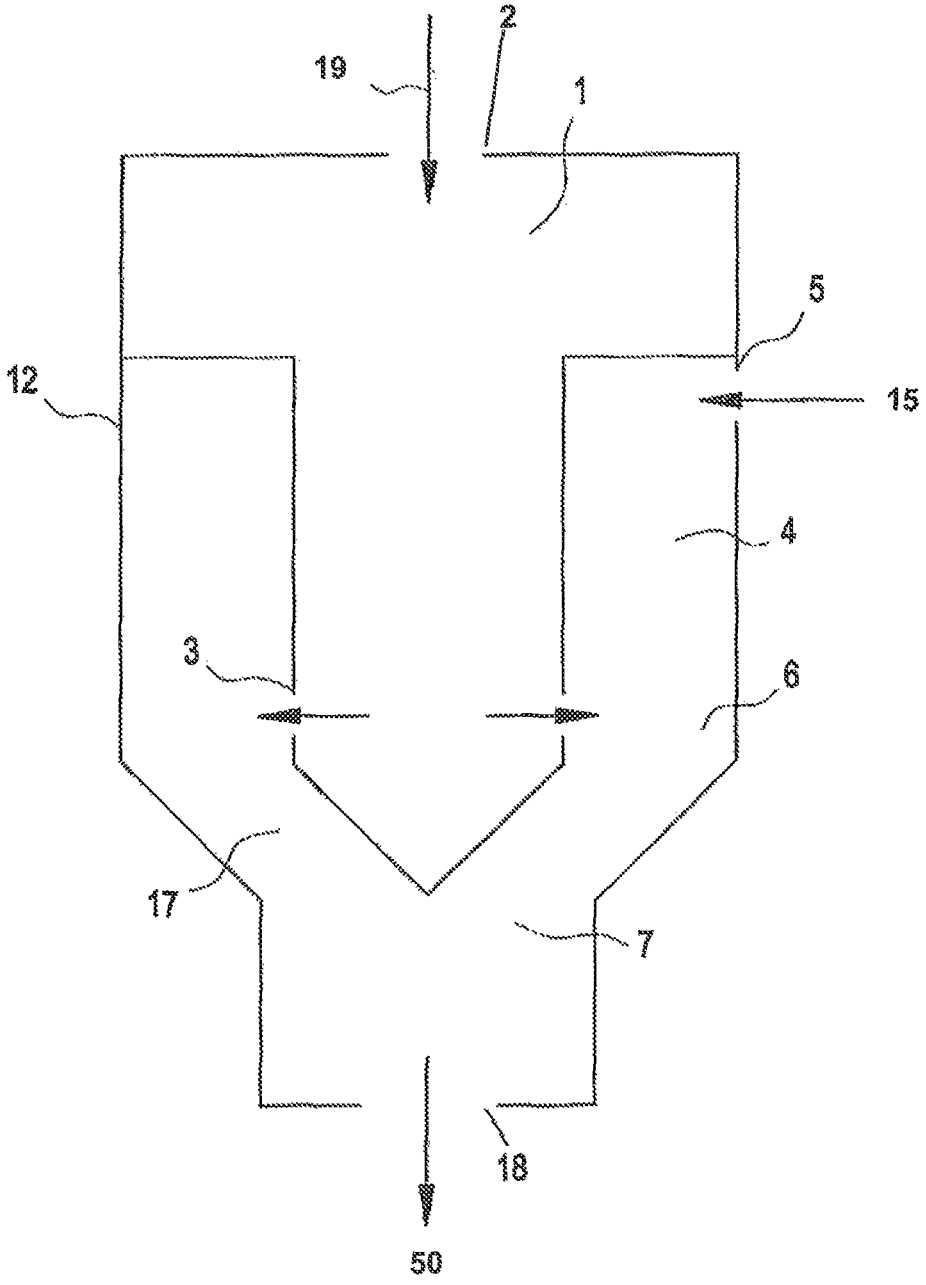
FIG. 7 represents a schematic illustration of an embodiment of a nozzle device.
Figure 9:
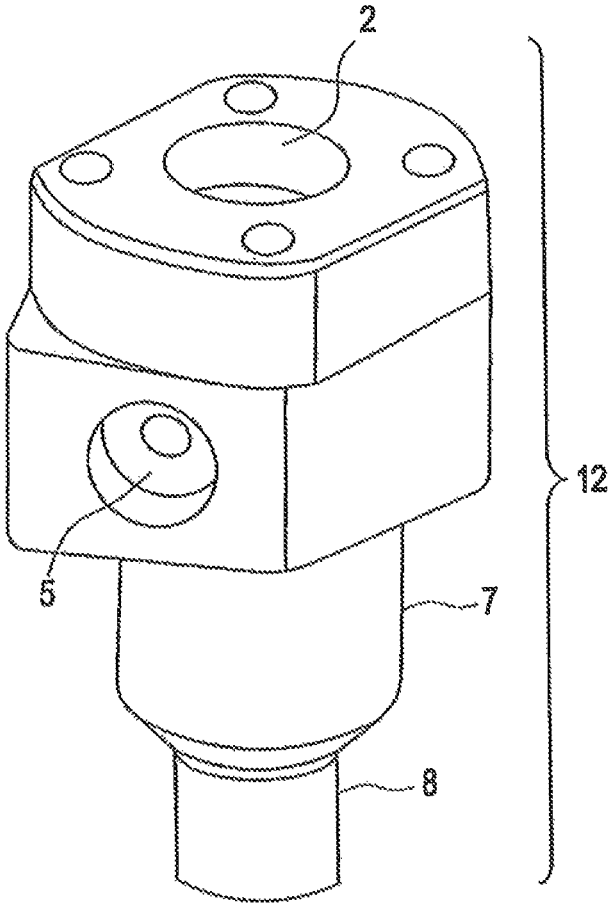
FIG. 9 is a side elevation view of an embodiment of a nozzle device.

Referring to FIGS. 6, 7, and 9, in certain embodiments, the pigment dispersion (in concentrated or dilute form) and/or the retention aid (inverted emulsion or uninverted emulsion or solution) (i.e., "at least one chemical species") (19) is introduced into the at least one inlet (2) of a first conduit (1) of a nozzle device (12). Subsequently, the at least one chemical species (19) flows through the first conduit (1) and out said at least one outlet (3) of the first conduit (1) and into the at least one inlet (17) of the mixing chamber (7). An aqueous liquid (15) is also introduced into a second conduit (4). The aqueous liquid (15) in the second conduit (4) swirls or vortexes around the first conduit (1), and exits through the at least one outlet (6) of the second conduit (4) and into the mixing chamber (7) via the inlets (17) of the mixing chamber (7). The fluids from the first conduit (1) and the second conduit (4) mix in the mixing chamber (7) and then the mixture (50) flows through the mixing chamber outlet (18), which is operably connected to the process line (9). For the illustrated embodiment, the nozzle device (12) is attached to the process line (9) via an optional adapter (8). The mixed fluids flow through the optional adaptor (8), which is mounted to an opening (16) in the process line (9). The mixed liquids flow into the flowing furnish (13).

All patents referred to herein, are hereby incorporated herein by reference, whether or not specifically done so within the text of this disclosure.

To the extent that the terms "include," "includes," or "including" are used in the specification or the claims, they are intended to be inclusive in a manner similar to the term "comprising" as that term is interpreted when employed as a transitional word in a claim. Furthermore, to the extent that the term "or" is employed (e.g., A or B), it is intended to mean "A or B or both A and B." When the applicants intend to indicate "only A or B but not both," then the term "only A or B but not both" will be employed. Thus, use of the term "or" herein is the inclusive, and not the exclusive use. See Bryan A. Garner, A Dictionary of Modern Legal Usage 624 (2d ed, 1995). Also, to the extent that the terms "in" or "into" are used in the specification or the claims, it is intended to additionally mean "on" or "onto." Furthermore, to the extent that the term "connect" is used in the specification or the claims, it is intended to mean not only "directly connected to," but also "indirectly connected to" such as connected through another component or components. In the present disclosure, the words "a" or "an" are to be taken to include both the singular and the plural. Conversely, any reference to plural items shall, where appropriate, include the singular.

All ranges and parameters disclosed herein are understood to encompass any and all sub-ranges assumed and subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more (e.g., 1 to 6.1), and ending with a maximum value of 10 or less (e.g., 2.3 to 9.4, 3 to 8, 4 to 7), and finally to each number 1, 2, 3, 4, 5, 6, 7, 8, 9, and 10 contained within the range.

While the present disclosure has been illustrated by the description of embodiments thereof, and while the embodiments have been described in considerable detail, it is not the applicants' intent to restrict or in any way limit the scope of the appended claims to such detail. Additional advantages and modifications will readily appear to those skilled in the art. Therefore, the disclosure, in its broader aspects, is not limited to the specific details, the representative apparatus, or the illustrative examples shown and described. Accordingly, departures may be made from such details without departing from the spirit or scope of the applicants' general inventive concept.

What is claimed is:

1. A method of delivering a pigment dispersion and an inverted retention aid emulsion to a papermaking process, the method comprising:

injecting the pigment dispersion and the inverted retention aid emulsion via separate nozzle devices into a process line of the papermaking process;

wherein the pigment dispersion comprises titanium dioxide;

wherein the process line is located downstream from a screen and upstream from a headbox; and wherein the pigment dispersion and the inverted retention aid emulsion are injected into the process line at a pressure of from about 80 psig to about 160 psig.

2. The method of claim 1, wherein the pigment dispersion and the inverted retention aid emulsion are injected no more than six inches upstream or downstream from one another.

3. The method of claim 1, wherein the pigment dispersion and the inverted retention aid emulsion are injected in the same cross-section of the process line.

4. The method of claim 1, sherein the pigment dispersion and the inverted retention aid emulsion are injected simultaneously in time.

5. The method of claim 1, wherein each nozzle device comprises:

a first conduit having at least one inlet and at least one outlet;

a second conduit having at least one inlet and at least one outlet, wherein the first conduit secures to the second conduit and traverses the second conduit;

a mixing chamber having at least one inlet and at least one outlet, wherein the second conduit secures to the mixing chamber and wherein the at least one outlet of the first conduit and the at least one outlet of the second conduit are in fluid communication with the mixing chamber; and wherein each of the nozzle devices is operably connected to the process line.

6. The method of claim 1, wherein the inverted retention aid emulsion comprises an anionic flocculant.

7. The method of claim 6, wherein the anionic flocculant comprises an anionic polyacrylamide.

8. The method of claim 1, wherein the inverted retention aid emulsion becomes inverted at the nozzle device utilized for injecting the inverted retention aid emulsion.

9. The method of claim 1, wherein the pigment dispersion and the inverted retention aid emulsion are injected no more than twelve inches upstream or downstream from one another.

10. A method of delivering a pigment dispersion and an inverted retention aid emulsion to a papermaking process, the method comprising:

injecting the pigment dispersion into a process line of the papermaking process via a first nozzle device, wherein the pigment dispersion comprises titanium dioxide and water;

injecting the inverted retention aid emulsion into the process line of the papermaking process via a second nozzle device, wherein the inverted retention aid emulsion comprises a flocculant and water;

wherein the process line is located downstream from a screen and upstream from a headbox; and wherein the pigment dispersion and the inverted retention aid emulsion are injected into the process line at a pressure of from about 80 psid to about 160 psig.

11. The method of claim 10, wherein the pigment dispersion and the inverted retention aid emulsion are injected no more than six inches upstream or downstream from one another.

12. The method of claim 10, wherein the pigment dispersion and the inverted retention aid emulsion are injected in the same cross-section of the process line.

13. The method of claim 10, wherein the pigment dispersion and the inverted retention aid emulsion are injected simultaneously in time.

14. The method of claim 10, wherein the inverted retention aid emulsion comprises an anionic flocculant.

15. The method of claim 14, wherein the anionic flocculant comprises an anionic polyacrylamide.

16. The method of claim 10, wherein the inverted retention aid emulsion becomes inverted at the second nozzle device.

17. The method of claim 10, wherein the pigment dispersion and the inverted retention aid emulsion are injected no more than twelve inches upstream or downstream from one another.

18. A method of optimizing pigment use in a papermaking process, the method comprising:

injecting a pigment dispersion and an inverted retention aid emulsion to a process line of the papermaking process via separate nozzle devices;

wherein the process line operably connects a screen and a headbox;

wherein the pigment dispersion and the inverted retention aid emulsion are injected equidistant from the headbox;

wherein the pigment dispersion comprises titanium dioxide; and wherein the inverted retention aid emulsion comprises an anionic flocculant; and wherein the pigment dispersion and the inverted retention aid emulsion are injected into the process line at a pressure of from about 80 psig to about 160 psig.

19. The method of claim 18, wherein the inverted retention aid emulsion becomes inverted at the nozzle device utilized for injecting the inverted retention aid emulsion.

20. The method of claim 18, wherein the pigment dispersion and the inverted retention aid emulsion are injected no more than twelve inches upstream or downstream from one another.

* * * * *